United States Patent [19]

Esker

[11] 4,219,170

[45] Aug. 26, 1980

[54] MISSILE ROLL POSITION PROCESSOR

[75] Inventor: Andrew T. Esker, Florissant, Mo.

[73] Assignee: McDonnell Douglas Corporation, St. Louis, Mo.

[21] Appl. No.: 813,814

[22] Filed: Jul. 8, 1977

[51] Int. Cl.[2] ..... F14G 7/00; A23G 9/00; G01C 3/08

[52] U.S. Cl. ..... 244/3.14; 250/203 R; 356/4

[58] Field of Search ..... 244/3.13, 3.14, 3.16

[56] References Cited

U.S. PATENT DOCUMENTS

| | | | |
|---|---|---|---|
| 3,219,294 | 11/1965 | Welti | 244/3.16 |
| 3,820,742 | 6/1974 | Watkins | 244/3.16 |
| 4,047,678 | 9/1977 | Miller, Jr. et al. | 244/3.16 |

*Primary Examiner*—Stephen C. Bentley
*Assistant Examiner*—Thomas H. Webb
*Attorney, Agent, or Firm*—Lionel L. Lucchesi

[57] ABSTRACT

A weapon system using a line of sight guidance system is provided with a missile containing two symmetrically located optical receivers. Information contained in a beam into which a missile is launched is used by the two receivers and associated processor means to derive roll position for the missile. Because the roll signal is derived electronically, mechanical means for determining roll position of the missile in the form of a conventional roll gyro, for example, may be eliminated. Elimination of the mechanical roll gyro from the missile permits much higher launch accelerations than are realistically feasible with missile control systems employing mechanically derived roll data. A processor located in the missile receives its signals from the pair of optical receivers. The processor uses the data from the first receiver to derive the position error of the missile relative to beam center. The data of the second receiver is used by the processor, along with a phase angle reference from the first receiver signal to develop a signal representation of the missile roll angle. The signal representation is further processed, when used with missile control systems requiring the roll reference signal in the form of a linear voltage with missile roll angle, to develop a missile roll angle reference in the form of two ramp voltages, each representing 360° of missile roll angle and being separated in phase by 180°.

10 Claims, 4 Drawing Figures

MISSILE ROLL POSITION PROCESSOR

BACKGROUND OF THE INVENTION

This invention relates to a weapon system utilizing a line of sight guidance system in a beamrider missile, and in particular, to a system carried by the missile for obtaining missile roll position data. While the invention is described in particular detail with respect to a weapon system and missile control use, those skilled in the art will recognize the wider applicability of the inventive concepts disclosed hereinafter.

The prior art reveals a number of missile systems utilizing a missile launched into a projected beam, the missile flying along the line of sight of the beam to an intended target. One particular prior art device with which the invention disclosed hereinafter is useful is disclosed in a U.S. Pat. by Andrew T. Esker et al, No. 4,014,482, issued Mar. 29, 1977. The control system disclosed in Esker et al in turn is compatible with a missile disclosed in a U.S. Pat. to Tucker, No. 3,868,833, issued Mar. 4, 1975. The missile disclosed in the Tucker patent includes thruster elements, the firing rate and firing direction of which are controlled to position the missile. Esker et al, U.S. Pat. No. 4,014,482, discloses a line of sight guidance system in which the radiated output of a pulsed laser is spacially modulated to produce a beam radiated from an optical projector. The radiated beam contains all informational parameters required to enable a missile launched into the beam to determine its position with respect to beam center. Esker et al may be used in conjunction with the Tucker missile and offers certain operational improvements over the missile control system described in Tucker. Esker et al, U.S. Pat. No. 4,014,482, and Tucker, U.S. Pat. No. 3,868,833 are intended to be incorporated by reference herein.

In the Tucker and Esker et al patents, the missile configurations disclosed employ a conventional inertially stabilized position gyro for determining the roll position of the missile. While such gyros work for their intended purpose, they are handicapped because the mechanical designs of the gyros require limitations on the acceleration rates of the missile. Generally, the acceleration limitation is below one thousand g's (standard acceleration of gravity unit). High launch accelerations, i.e., over one thousand g's are desirable in order to reduce the time of missile flight to the target and thereby reduce the time period in which the gunner is susceptible to counter fire from the intended target.

As disclosed hereinafter, the missile of this invention is provided with a pair of optical receivers. The optical receivers are located on the missile a fixed distance apart, facing a beam projector at the launch site. Signals obtained from the first receiver are processed as disclosed in the above-referenced Esker et al patent, U.S. Pat. No. 4,014,482, for deriving the displacement error of the missile with respect to the beam center. The signal from the second receiver is used, together with the phase angle reference obtained in deriving the missile displacement error from beam center, in determining roll displacement error. The displacement errors from each axis are added and divided by two. The resulting error is then processed through a stabilization network and is utilized to develop missile roll angle reference in the form of two ramp voltages, each representing 360° of missile roll angle separated in phase by 180°.

The prior art reveals a number of guidance systems including those which utilize dual radiation detectors from a single radiated beam source, as for example, described in U.S. Pat. to Ede, No. 3,557,372. The Ede patent, while working for its intended purpose, provides relatively low quality information unsuitable for precision control applications, required, for example, by the missile applications discussed in conjunction with this invention.

One of the objects of this invention is to provide a low cost means for determining roll position error in a guided object.

Another object of this invention is to provide system means for determining roll position error electronically.

Yet another object of this invention is to provide a missile system in which the roll position sensor in the missile is capable of withstanding acceleration forces in excess of one thousand g's.

Another object of this invention is to give roll position information and derived roll rate information to a guidance system in the form of pulses contained in the guidance beam, the sensitivity of the roll position information being essentially independent of the amplitude of the received pulses.

Other objects of this invention will be apparent to those skilled in the art in light of the following description and accompanying drawings.

SUMMARY OF THE INVENTION

In accordance with this invention, generally stated, a guidable device is provided with an electronic signal processor for developing roll position data for the device. In the preferred embodiment, a pair of optical receivers are mounted to a guidable projectile so as to face a radiated beam source. The first receiver is connected to a signal processing channel that determines phase angle and distance to the beam centerline. The second receiver is connected to a signal processing channel which utilizes the phase angle data derived in the first channel to develop signal representations of roll position for the missile. The roll signal representations are further processed so that two ramp voltages are generated, each representing 360° of missile roll angle, but separated in phase by 180°. The roll position data is used thereafter in positioning the missile properly along the projected beam centerline.

DESCRIPTION OF THE PREFERRED EMBODIMENT

Figure 4:
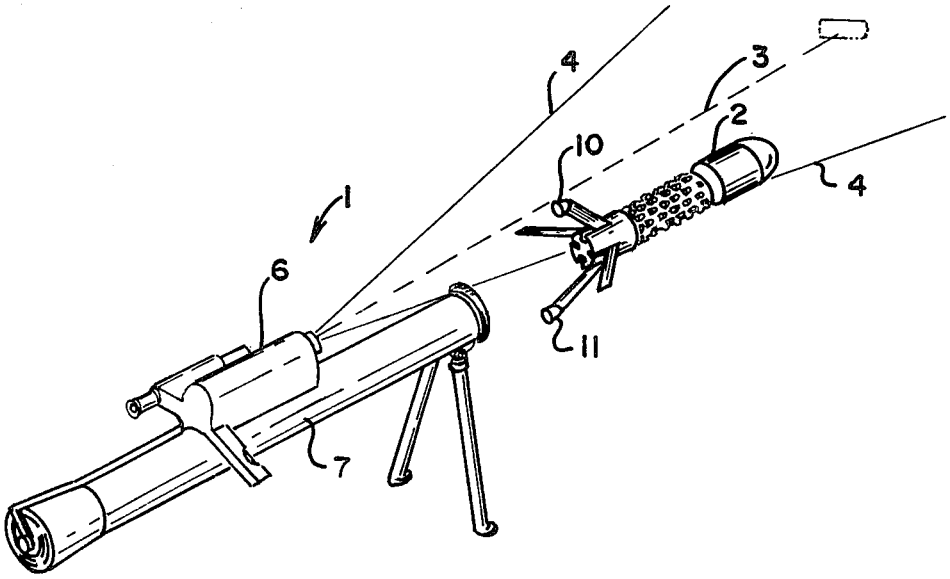
FIG. 4 is a diagrammatic representation of a weapon system employing my invention.

Referring now to FIG. 4, reference numeral 1 indicates a guidance system for directing a projectile, for example, a missile 2, along a centerline axis 3 of a beam 4 which illuminates both the missile 2 and any intended target. The beam 4 is generated by a missile director 6 associated with a launch device 7. The launch device 7 and missile 2 may comprise any of a variety of suitable projectile and launcher vehicles. As indicated above, the missile and launcher described in the Tucker U.S. Pat. No. 3,868,833, is particularly well adapted for use with the invention described hereinafter. Likewise, the director 6 preferably is similar to that described in the Esker et al U.S. Pat. No. 4,014.482. Both the Esker et al and Tucker patents are intended to be incorporated by reference herein.

Figure 1:
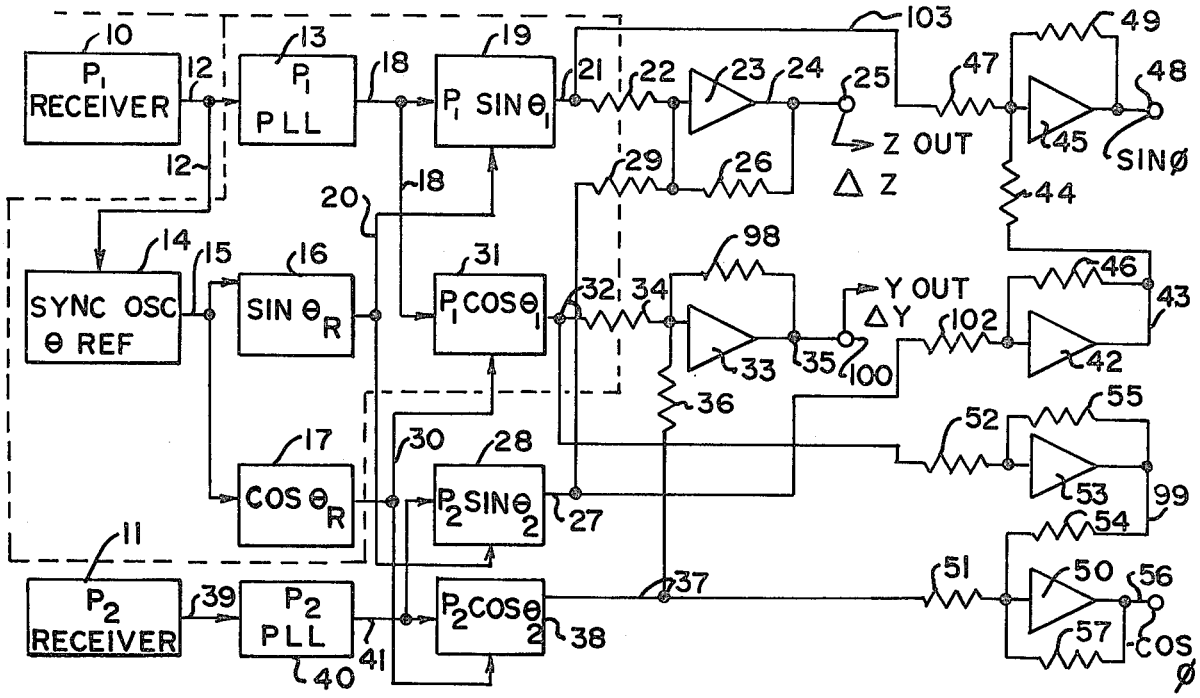
FIG. 1 is a block diagrammatic view of a processing system for developing a signal from which roll position data may be obtained.

My invention varies the disclosure of the Esker et al patent by providing a first receiver 10 and a second receiver 11, diagrammatically illustrated in FIG. 1, positioned at the missile 2 in spaced relationship with respect to one another so that the beam 4 projected by the missile director 6 impinges the receivers 10 and 11 during missile 2 flight. The receiver 10 has an input 12 connected both to a phase locked loop 13 and to a synchronous oscillator 14. The synchronous oscillator 14 has an output side 15 connected to a phase shifter 16 and a phase shifter 17. An output 18 of the phase locked loop 13 forms a first input to a product demodulator 19 while an output 20 of the phase shifter 16 forms the second input to the product demodulator 19. An output 21 of the product demodulator 19 forms an input through a resistor 22 to an operational amplifier 23. An output 24 of the amplifier 23 is provided at a terminal 25 for use by the missile 2 as discussed in the above-referenced Esker et al U.S. Pat. No. 4,014,482. Output 24 also is fed back to the input side of the amplifier 23 along a resistor 26. The signal at output 24 also is fed, via a resistor 29 to an output 27 of a product demodulator 28.

An output 30 of the phase shifter 17 forms a first input to a product demodulator 31. A second input to the product demodulator 31 is obtained from the output 18 of the phase locked loop 13. An output 32 of the product demodulator 31 forms a first input to an operational amplifier 33 along a resistor 34. An output 35 of the amplifier 33 is provided at a terminal 100 for use by the missile 2 as discussed in the above-referenced Esker et al U.S. Pat. No. 4,014,482. The output 35 is fed to the input side of the amplifier 33 along a feedback resistor 98. The input of the amplifier 33 also is electrically connected through a resistor 36 to an output side 37 of a product demodulator 38.

As indicated, the receiver 11 is separated from the receiver 10 by some predetermined distance. Receiver 11 has an output 39 which forms an input to a phase locked loop 40. An output 41 of the phase locked loop 40 forms a first input to the product demodulator 38 and a first input to the product demodulator 28. The second input to the demodulators 28 and 38 is obtained from the phase shifter 16 and the phase shifter 17, respectively. The output 27 of the product demodulator 28 forms an input, along a resistor 102, to an operational amplifier 42. An output 43 of the operational amplifier 42 forms a first input, along a resistor 44, to an operational amplifier 45. A resistor 46 is connected between the output 43 and the input side of the operation amplifier 42 in a conventional manner.

The output 21 of the product demodulator 19 also is connected to the input side of the operational amplifier 45 along a conductor 103 and a resistor 47. An output side 48 of the operational amplifier 45 is a signal representation of the sine of the roll angle $\phi$ which is processed as described hereinafter. Amplifier 45 has feedback loop connected between its output side 48 to its input side, the loop including a resistor 49.

The output 37 of product demodulator 38 forms an input to an operational amplifier 50 along a resistor 51. The output 32 of the product demodulator 31 also forms an input, along a resistor 52, to an operational amplifier 53. An output 99 of operational amplifier 53 is connected to the input side of the operational amplifier 50 through a resistor 54. The operational amplifier 53 has a feedback resistor 55 connected between its output side 99 and its input side in a conventional manner. The operational amplifier 50 has an output 56 corresponding to the cosine of the roll angle $\phi$. Operational amplifier 50 also has a feedback resistor 57 connected between its output side 56 and its input side in a conventional manner.

Figure 2:
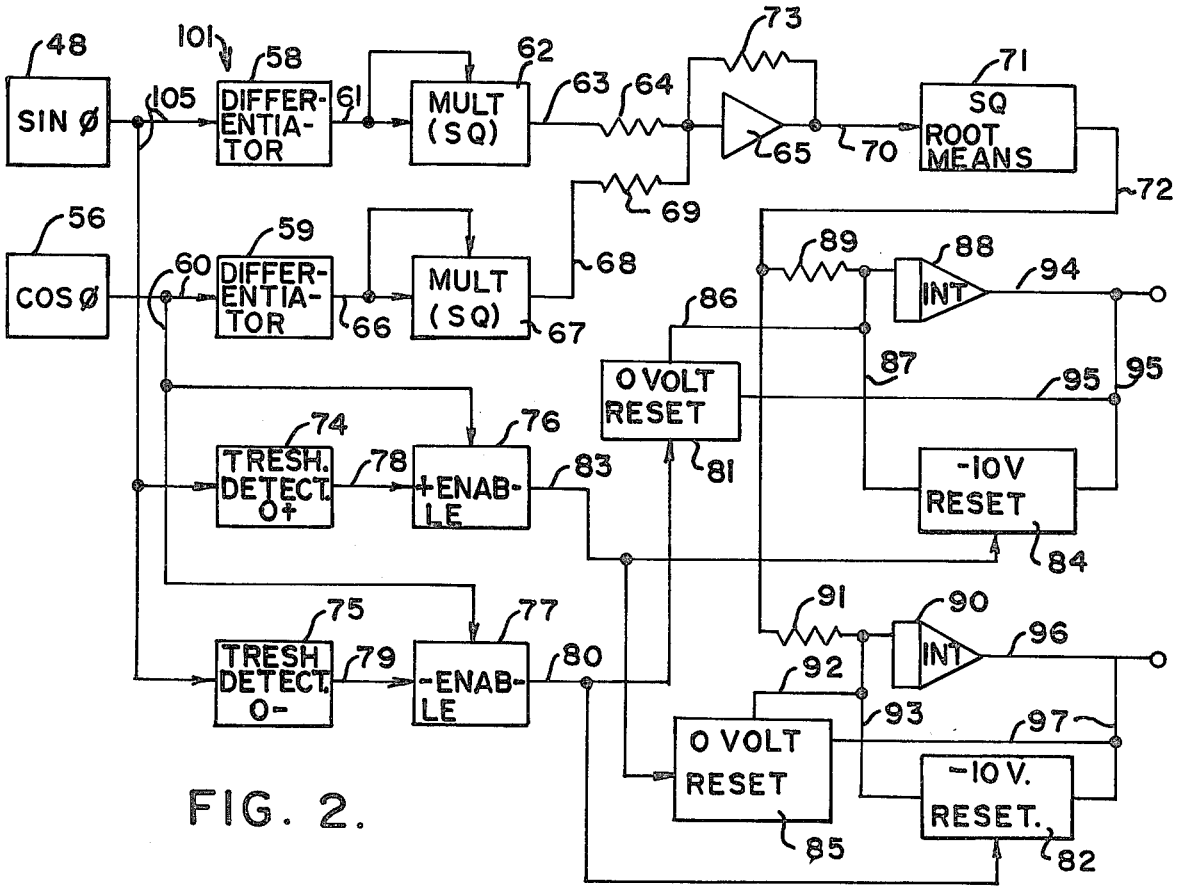
FIG. 2 is a block diagrammatic view of a processor system for generating ramp voltage representations of roll position data based on the signals provided by the system of FIG. 1.

A processor 101, shown in FIG. 2, obtains the sine function of the roll angle $\phi$ from the output 48 of FIG. 1. That signal is fed along a conductor 105 to a differentiator 58, while the cosine function of the roll angle $\phi$, obtained from the output 56 in FIG. 1, is fed to a differentiator 59 along a conductor 60. An output 61 of the differentiator 58 forms an input to a multiplying means 62, the output 63 of which forms an input to an operational amplifier 65 along a resistor 64.

An output 66 of the differentiator 59 is an input to a multiplying means 67. An output 68 of the multiplying means 67 also forms an input to the operational amplifier 65 along a resistor 69. An output 70 of the operational amplifier 65 is an input to a square root means 71, an output 72 of which represents the magnitude of the roll rate. Operational amplifier 65 has a feedback resistor 73 electrically connected between its output side 70 and its input side in a conventional manner.

The conductor 105 also feeds the sine function representation of the roll angle $\phi$ to a pair of threshold detectors 74 and 75, respectively. The conductor 60 is connected to a pair of enable gate means 76 and 77, respectively. An output 78 of the threshold detector 74 is connected to the enable gate means 76, while an output 79 of the threshold detector 75 is connected to the enable gate means 77. An output 80 of the enable gate means 77 is connected to a zero volt reset means 81 and to a minus 10 volt reset means 82.

An output 83 of the enable gate means 76 is connected to a minus 10 volt reset means 84 and to a zero volt reset means 85. An output 86 of the zero volt reset means 81 is connected to an ouput 87 of the minus 10 volt reset means 84 and to the input side of a ramp generator means 88. The output 72 of the square root means 71 also is connected to the input of the ramp generator means 88 along a resistor 89 and to the input side of a ramp generator means 90 along a resistor 91.

An output 92 of the zero volt reset means 85 is connected to the output 93 of the minus 10 volt reset means 82 and both are connected to the input side of the ramp generator means 90.

An output 94 of the ramp generator means 88 represents a first ramp voltage representation of roll position which also is fed back to the reset means 81 and the reset means 84 along a feedback loop conductor 95. An output 96 of the ramp generator means 90 is a second ramp voltage representation of roll angle, which also is fed back to the reset means 85 and the reset means 82 along a feedback loop conductor 97.

Operation of the processor 101 is relatively easy to understand. The processor 101 differentiates the sine and cosine functions to obtain a voltage proportional to the missile roll rate. The magnitude of the missile roll rate then is obtained by squaring both differentiated signals, summing those signals, and taking their square root. The magnitude of the roll rate signal then is used as inputs to the roll position ramp generating means 88 and 90. To initiate the ramps at the desired roll angle, the reset means 84 and 82 are activated by pulses from threshold detectors 74 and 75. The threshold detector 74 pulses each time the sine $\phi$ signal passes through zero. When the cosine function is positive, enable gate means 76 permits the threshold detector 74 pulse to reset the ramp generator means 90 to zero and to reset the ramp generator 88 to minus 180°. The threshold detector 75 also pulses each time the sine function passes through zero. When the cosine function is negative, enable gate means 77 permits the output of the threshold detector 75 to reset the ramp generator means 90 to minus 180° and the ramp generator means 88 to 0°. The reset at 0° can be made dependent upon the error from zero volts existing at the time of the update pulse through the use of the respective reset means 81 and 85. The advantage in updating is the removal of ramp generator means 88 and 90 drift which may have occurred during one half of the missile roll cycle.

Figure 3:
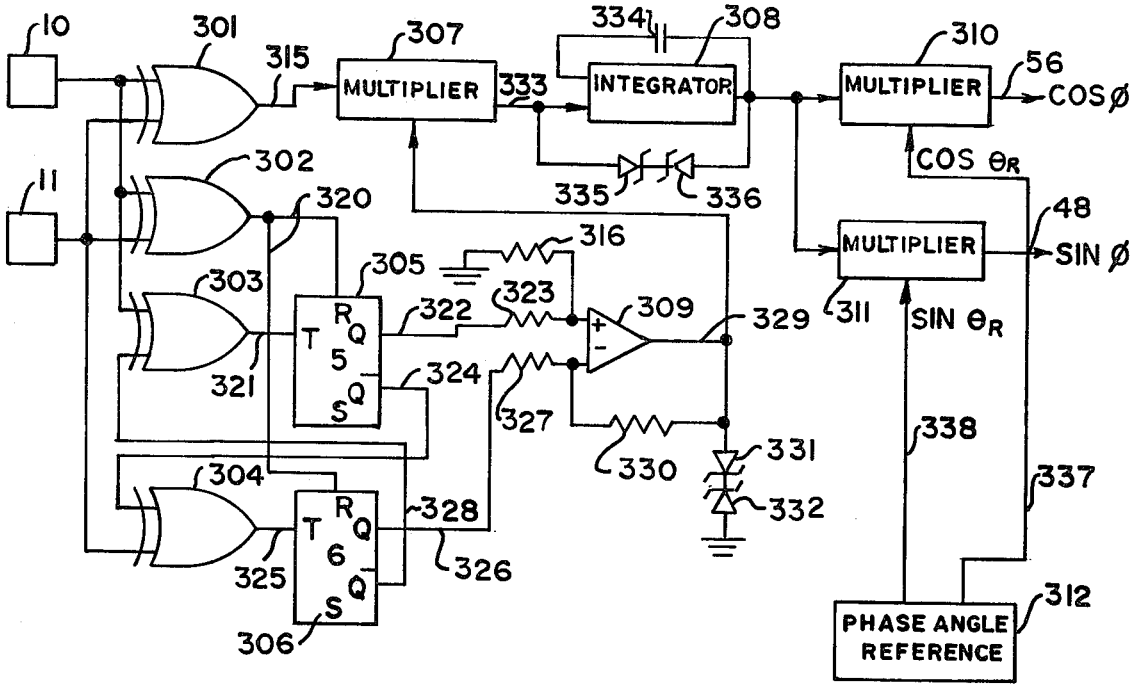
FIG. 3 is a second illustrative embodiment of a processor system for developing a signal from which roll position data may be obtained.

A second method for obtaining the missile roll angle reference signal is shown in FIG. 3. As there illustrated, the receiver 10 is connected to the A input of an exclusive OR gate 301, the A input of an OR gate 302 and the A input of an exclusive OR gate 303. An output 315 of the gate 301 is an input to a multiplier means 307.

The receiver 11 is connected to the B input of gate 301, the B input of the gate 302, and the B input of an exclusive OR gate 304. An output 320 of the gate 302 is connected to the R input of a flip-flop 305, and to the R input of a flip-flop 306. An output 321 of the exclusive OR gate 303 is connected to the T input of the flip-flop 305. An output 322 of the flip-flop 305 is connected through a resistor 323 to the positive input of an operational amplifier 309. The positive input of the amplifier 309 is connected to ground through a resistor 316. An output 324 of the flip-flop 305 is connected to the A input of the exclusive OR gate 304. An output 325 of the OR gate 304 forms the T input to the flip-flop 306.

An output 326 of the flip-flop 306 is connected to the negative input terminal of the operational amplifier 309 through a resistor 327. A resistor 330 is connected between an output 329 and the negative input terminal of the amplifier 309. A pair of oppositely poled Zener diodes 331 and 332, respectively, are connected between the output side 329 of the amplifier 309 and electrical ground. An output 328 of the flip-flop 306 is connected to the second input terminal of the gate 303. The output 329 of the amplifier 309 is connected to a second input of the multiplier means 307.

An output 333 of the multiplier 307 is an input to an integrator 308. Integrator 308 is conventional and may include a capacitor 334 and a pair of oppositely poled Zener diodes 335 and 336 arranged between the output and input sides of the integrator in a conventional manner. The output of the integrator 308 forms an input to a pair of multiplier means 310 and 311, respectively. Phase angle reference means 312, which, for example, may correspond to the output 20 and 30 of FIG. 1, provides an input 337 and an input 338 to the multiplier means 310 and 311. The outputs of the multiplier means 310 and 311 are equivalent to the outputs 48 and 56 of FIG. 1.

The circuit just described provides a missile roll angle in the form of its sine and cosine, that function being derived from the time of arrival of pulses from the two receivers 10 and 11. Output from the exclusive OR gate 301 is available when a pulse is present from the receiver 10, or 11, but a pulse from the gate 301 is not available when both receivers 10 and 11 have an output present at the gate 301, or when no pulses are present. In the circuit for the preferred embodiment of the system, pulses on the output side of the exclusive OR gate 301 are seen as pairs which vary from 0 to 132 microseconds at a 60 hertz rate. The multiplier 307 receives inputs from the exclusive OR gate 301 and the operational amplifier 309. Operational amplifier 309 functions as a unity, fixed amplitude, pulse generator having an output of plus or minus 1. The polarity of the output of amplifier or pulse generator 309 is a function of the time of arrival or pulses from the receivers 10 and 11. The output 333 of the multiplier 307 is a string of plus and minus pulses varying in width at a 30 hertz rate. The integrator 308 converts the pulses to a 30 hertz voltage with a 90° phase shift. The multipliers 310 and 311 resolve the 30 hertz signal into the sine and cosine of the missile roll angle. The position information, indicated as sine $\theta_r$ and cosine $\theta_r$ is derived from the phase reference channel described in conjunction with FIG. 1.

The phase of the unity pulse generator 309 is established by the time of arrival of pulses from the receivers 10 and 11. The OR gate 302 output resets both of the bistable flip-flops 305 and 306 at the trailing edge of the later of the two pulses. With the flip-flops 305 and 306 in their reset positions, the outputs 324 and 328 enable the gates 304 and 303, respectively. The first pulse to arrive, from either of the receivers 10 and 11, sets the respective bistable flip-flop. The second pulse is then inhibited from activating its bistable flip-flop. The activated flip-flop determines the polarity of the output of the pulse generator 309.

Numerous variations, within the scope of the appended claims, will be apparent to those skilled in the art in light of the foregoing description and accompanying drawings. Thus, the processor of this invention is compatible with other missile systems, in addition to those described in conjunction with the above-referenced Tucker and Esker et al patents. Likewise, the processor may be used in devices in addition to the weapon system application disclosed herein. Various components or designs indicated as preferred may be changed in other designs or in other applications of the invention. It will be understood that certain features and subcombinations of the invention are of utility and may be employed without reference to other features and subcombinations. With the information disclosed in the drawings and described hereinabove, those skilled in the art will be able to construct physical circuits from the block diagrams shown. If additional circuit design information is desired, it may be obtained, for example, in *Phase Lock Techniques,* Floyd M. Gardner, John Wiley and Sons, 1966 (*Op Amps Replace Transformer In Phase-Detector Circuit,* A Gauge, Electronics, 1969; and *Characteristics and Applications of Modular Analog Multipliers,* E. Zuch, Electronic Instrumentation Digest, April, 1969). These variations are merely illustrative.

Having thus described the invention, what is claimed and desired to be secured by Letters Patent is:

1. In a missile system including a missile capable of being directed toward a target, means for generating a binary coded beam of electromagnetic wave energy, and means of said missile for positioning said missile at the center of said beam, the improvement which comprises means for electronically establishing a roll angle reference signal for said missile, said roll angle reference signal establishing means including a first optical receiver at the missile facing the beam generating means, a second optical receiver at the missile facing the beam generating means, said first and said second receivers being separated from one another by some predetermined distance, means for determining an electrical signal representation of the sine function of the missile roll position angle, means for determining an electrical signal representation of the cosine function of the missile roll position angle, means for differentiating the sine and cosine functions of missile roll position angle to obtain an electrical signal proportional to missile roll rate, means for squaring the differentiated sine and cosine functions, means for summing the output of the squaring means, means for determining the square root of the sum of the squared signals, first integrator means operatively connected to the output of the square root obtaining means, and second integrator means operatively connected to the output of the square root obtaining means, the output of said first and said second integrator means being a ramp voltage representing 360 degrees of roll position data separated by 180 degrees.

2. The missile system of claim 1 further including reset means operatively connected to the respective input sides of said first and said second integrator means.

3. The missile system of claim 2 further including means for controlling the operation of said reset means.

4. In a missile system including a missile capable of being directed toward a target, means for generating a binary coded beam of electromagnetic wave energy, and means at said missile for positioning said missile at the center of said beam, the improvement which comprises means for electronically establishing a roll angle reference signal for said missile, said roll angle reference signal establishing means including a first optical receiver at said missile facing the beam generating means, a second optical receiver at the missile facing the beam generating means, said first and said second receivers being separated from one another by some predetermined distance, means operatively connected to said first and said second receiver for determining an electrical signal representation of the sine function of the missile roll position angle, means operatively connected to said first and said second receivers for determining an electrical signal representation of the cosine function of the missile roll position angle, and processor means operatively connected to said sine and cosine missile roll angle determining means for establishing a first and second ramp voltage, each of said ramp voltages representing 360 degrees of missile roll angle but separated in phase by 180 degrees.

5. The missile system of claim 2 wherein said processor means includes an exclusive OR gate, first multiplier means connected to the output side of said exclusive OR gate, integrator means connected to the output side of said first multiplier means, second multiplier means operatively connected to the output side of said integrator, third multiplier means operatively connected to the output side of said integrator, and timing means operatively connected to said receivers and to said first multiplier means.

6. The missile system of claim 3 wherein said timing means includes a first flip-flop, a second flip-flop, means for gating said first and said second flip-flops operatively connected between said first and said second receivers and said first and said second flip-flops, and constant generating means connected to the output side of said flip-flops and an input of said first multiplier means.

7. The missile system of claim 2 wherein processor means includes means operatively connected to said first and said second receiver for determining an electrical signal representation of the sine function of the missile roll position angle, means operatively connected to said first and said second receivers for determining an electrical signal representation of the cosine function of the missile roll position angle, means for differentiating the sine and cosine functions to obtain an electrical signal proportional to missile roll rate, means for squaring the differentiated sine and cosine functions, means for summing the squared signals, means for obtaining the square root of the sum of the squared signals, first integrator means operatively connected to the output side of the square root obtaining means, and second integrator means operatively connected to the output side of the square root obtaining means.

8. The missile system of claim 7 further including reset means operatively connected to the respective input sides of said first and said second integrator means.

9. The missile system of claim 8 further including means for controlling the operation of said reset means.

10. A missile system, comprising:

a missile capable of being directed toward a target; means for generating a radiant beam of electromagnetic wave energy;

means at said missile for positioning said missile at the center of said radiated beam; and means for electronically establishing a roll reference signal for said missile, said roll angle reference signal establishing means including a first optical receiver at said missile facing the beam generating means, a second optical receiver at the missile facing the beam generating means, said first and second receivers being separated from one another, means operatively connected to said first and said second receiver for determining an electrical signal representation of the sine function of the missile roll position angle, means operatively connected to said first and said second receivers for determining an electrical signal representation of the cosine function of the missile roll position angle, and processor means operatively connected to said sine and cosine missile roll angle determining means for establishing a first and a second ramp voltage, each of said first and said second ramp voltages representing 360 degrees of missile roll angle but separated in phase by 180 degrees.

* * * * *